US006805256B1

(12) United States Patent
Plasterr

(10) Patent No.: US 6,805,256 B1
(45) Date of Patent: Oct. 19, 2004

(54) PUMP DISPENSER PLUG

(76) Inventor: Norma L. Plasterr, P.O. Box 129, 100 Garett Fork Rd., Chapmanville, WV (US) 25508

( * ) Notice: Subject to any disclaimer, the term of this patent is extended or adjusted under 35 U.S.C. 154(b) by 0 days.

(21) Appl. No.: 10/413,707

(22) Filed: Apr. 15, 2003

(51) Int. Cl.[7] ..... B65D 43/04
(52) U.S. Cl. ..... 220/801; 215/354; 222/546
(58) Field of Search ..... 220/800–802, 220/203.13, DIG. 19; 215/354, 355, 320, 294, 296; 222/546, 552, 554, 563, 212, 420

(56) References Cited

U.S. PATENT DOCUMENTS 1,730,202 A * 10/1929 Geyer ..... 220/801
2,276,606 A * 3/1942 August ..... 220/284
2,321,667 A * 6/1943 Sydney ..... 220/802
2,737,953 A * 3/1956 Rudolph ..... 604/285
4,221,752 A * 9/1980 Bray ..... 264/121
4,724,278 A * 2/1988 Smith ..... 174/38
4,879,158 A * 11/1989 Horiki et al. ..... 428/159
5,276,424 A 1/1994 Hegemann
5,755,051 A 5/1998 Zumbuhl
5,779,085 A * 7/1998 Havlinek et al. ..... 220/234
D405,377 S 2/1999 Davis
6,035,567 A 3/2000 Cameron
6,098,802 A * 8/2000 Asa et al. ..... 206/443
6,134,819 A 10/2000 McClain et al.
6,204,777 B1 3/2001 Lyons
6,363,641 B1 4/2002 Martinez

* cited by examiner

*Primary Examiner*—Lien Ngo

(57) ABSTRACT

The pump dispenser plug is a flexible, conical plug that could be easily adapted through the use of removable layers to fit any type of pump dispenser container. When the container is not in use, the plug would be inserted into the pump nozzle opening to prevent the contents from drying and collecting on the outside tip. The plug has a circular base with a perpendicular shaft upon which is mounted a conical structure comprised of removable layers. The conical layers are formed of flexible plastic, and each has a longitudinal access slit cut along its outer surface. To reduce the size of the plug for smaller nozzle openings, the user would simply peel off the appropriate number of layers and discard them.

18 Claims, 3 Drawing Sheets

PUMP DISPENSER PLUG

BACKGROUND OF THE INVENTION

1. Field of the Invention

The present invention relates to an accessory for use in connection with pump dispenser containers. The pump dispenser plug has particular utility in connection with preventing the contents of pump dispenser containers from drying and collecting on the outside tip of the dispenser.

2. Description of the Prior Art

Pump dispensers have become popular in recent years, especially for products such as hand lotion and liquid soap. These types of dispensers allow easy access to the contents of the container, especially to the bottom portion of the contents. Previously, individuals would shake the container or stand it upside down to reach the contents left at the bottom, and many times the container would be discarded with the last portion of the contents remaining inside. Pump dispensers allow the use of the entirety of the contents without undue exertion by the user; however, the contents tend to collect on the tip of the pump nozzle and dry out. This forms a hardened blockage in the nozzle tip, which can clog the opening. When the pump is utilized after formation of this blockage, the product is forcefully expelled from the tip, sometimes causing spills and subsequent staining of clothing or carpeting. If the container has not been used for an extended amount of time, the blockage needs to be cleared before the dispenser will work. Pens, pencils, toothpicks, and other such items have been used to attempt to unblock the opening. Often times, the consumer will throw away the container with a portion of the contents remaining inside. Therefore, a device which could be inserted into the tip of a pump dispenser to prevent the contents from drying and collecting on the tip would save the consumer money by preventing premature replacement purchase and the staining of clothing and carpeting, as well as eliminating the aggravation of trying to clear blocked pump nozzles. In addition, a disposable device which could be used in this capacity and which could be adapted to fit most pump nozzle openings would be a useful item for a consumer to have around the house.

The use of caps for dispensing systems is known in the prior art. For example, U.S. Pat. No. 5,419,378 to Verl Law discloses a pour spout that consists of a hollow tube attachable at one end to a container of fluid and at the other end with an end cap in which is formed a fluid discharge opening through which fluid can be transferred. This device is intended for use in transferring gasoline from a storage tank into a gasoline powered piece of equipment, and similar situations in which fluid is transferred from an inverted container into a second storage compartment. However, the Law '378 patent implements a plurality of fluid discharge openings positioned annularly around the tube, which would be unsuitable for use with lotion and soap containers since it would allow these products to squirt out in all directions. Moreover, the Law '378 device is too large to be inserted into the tip of a pump dispenser nozzle and, if it could be attached, would cause the dispenser to tip over due to its length and weight. Finally, the Law '378 device has many parts and would not be considered disposable due to its cost, nor is it adaptable to various sized container openings.

U.S. Pat. No. 5,222,530 to Henry E. Baker, John B. Baker, David H. Baker, Peter K. Baker, Edward H. Donselman, and Ronald C. Katz discloses a hygienic cap to close the opening of an inverted liquid container for a potable liquid dispensing system. This device is intended for use with the inverted containers used by home and office water suppliers. However, the Baker, et al. '530 patent includes elements in the cap for insertion through a specific seal in these inverted liquid containers. These seals do not exist in most pump dispenser containers, and the elements of the cap which break these seals would serve to reduce the size of the nozzle, and thus the amount of product able to pass through the nozzle. Furthermore, the size of the Baker, et al. '530 device renders it unsuitable for use with most pump dispensers as they have a very small access opening. The Baker, et al. '530 device is also limited to covering a specific sized opening. Finally, the Baker, et al. '530 device could not be securely affixed to the tip of a pump dispenser, nor is it likely to be considered a disposable device.

Similarly, U.S. Pat. No. Des. 328,252 to Sanae Miyake discloses the ornamental design for a plug for a blood collecting tube. However, the Miyake '252 device could not be inserted into the tip of a pump nozzle and would allow the contents of the container to collect in the tip of the nozzle and form blockages. In addition, the size of the Miyake '252 device would prohibit it from being secured to a pump dispenser nozzle. Lastly, the Miyake '252 patent makes no indication that the device would be adaptable for covering devices of various sizes.

U.S. Pat. No. 5,289,854 to Henry E. Baker, John B. Baker, David H. Baker, Peter K. Baker, Edward H. Donselman, and Ronald C. Katz discloses a two-piece hygienic cap to close the neck opening of an inverted liquid container. This device is intended for use with the inverted containers used by home and office water suppliers. However, the Baker, et al. '854 patent includes elements in the cap for insertion through a specific seal in these inverted liquid containers. These seals do not exist in most pump dispenser containers, and the elements of the cap which break these seals would serve to reduce the size of the nozzle, and thus the amount of product able to pass through the nozzle. Furthermore, the size of the Baker, et al. '854 device renders it unsuitable for use with most pump dispensers as they have a very small access opening. The Baker, et al. '854 device is also limited to covering a specific sized opening. Finally, the Baker, et al. '854 device could not be securely affixed to the tip of a pump dispenser, nor is it likely to be considered a disposable device.

Likewise, U.S. Pat. No. 5,695,132 to Joseph F. Gorzka, Jr., Scott M. Smith, and Gene T. Tomasino discloses an air actuated nozzle plug that works in conjunction with a piston to block a nozzle when the pressure on the outside is greater than the pressure in the nozzle and allows access when the pressure outside is substantially lower than the pressure in the nozzle. However, the Gorzka, Jr., et al. '132 device would be unsuitable for use with most cosmetic type pump dispenser units since they do not include a piston which could operate the nozzle plug. Additionally, the Gorzka, Jr., et al. '132 device could not be inserted into the tip of a pump dispenser nozzle and would allow the product to collect in the nozzle tip. Finally, the Gorzka, Jr., et al. '132 nozzle plug could not be securely affixed to a pump dispenser, nor is there any indication that it is adaptable to various sized openings.

Lastly, U.S. Pat. No. 4,629,097 to David G. Moore discloses a snap-action orifice sealing plug for viscous product dispensers. The closure plug is hingedly and integrally attached to the pump actuator of the container. However, the Moore '097 device is intended for a specific type of container and would not be suitable for use with the pump dispenser containers in which liquid soap and lotion is typically packaged. Furthermore, the Moore '097 device is integrally connected to the pump actuator of the container and could not be exported to another container without a plug. Moreover, if the Moore '097 device were to break off the pump actuator, it would be difficult to reattach the device for effective use. Finally, the Moore '097 plug is not adaptable for use in containers with openings of various sizes.

While the above-described devices fulfill their respective, particular objectives and requirements, the aforementioned patents do not describe a disposable, adjustable pump dispenser plug that allows prevents the contents of pump dispenser containers from drying and collecting on the outside tip of the dispenser. None of the aforementioned devices is adaptable to plug openings of various sizes. Moreover, the Baker, et al. '530, the Baker, et al. '854, Gorzka, Jr., et al. '132, and Moore '097 devices are intended for use with specific types of containers that do not include an elongated pump nozzle and could even block such a nozzle if used in conjunction with a pump dispenser. Furthermore, the size of the Law '378, Baker, et al. '530, Miyake '252, and Baker, et al. '854 devices render them unsuitable for use with a pump dispenser container. In addition, the Baker, et al. '530, the Baker, et al. '854, and Gorzka, Jr., et al. '132 devices could not be securely affixed to a pump dispenser, while the Miyake '252 and Gorzka, Jr., et al. '132 devices could not be inserted into the tip of a pump dispenser nozzle and would allow the product to collect and dry in the nozzle tip. Not only are the Law '378 and the Moore '097 devices not disposable, but the Moore '097 plug is intergrally connected to the pump actuator of the container and could not be removed for use with another container. Furthermore, if the Moore '097 device were to break off the pump actuator, it would be difficult to reattach the device for effective use. Finally, the Law '378 patent implements a plurality of fluid discharge openings positioned annularly around the tube, which would be unsuitable for use with lotion and soap containers since it would allow these products to squirt out in all directions.

Therefore, a need exists for a new and improved pump dispenser plug that can be used for insertion into the tip of the nozzle of pump dispenser containers to prevent the contents from drying and collecting on the tip. In this regard, the present invention substantially fulfills this need. In this respect, the pump dispenser plug according to the present invention substantially departs from the conventional concepts and designs of the prior art, and in doing so provides an apparatus primarily developed for the purpose of preventing the contents of pump dispenser containers from drying and collecting on the outside tip of the dispenser.

SUMMARY OF THE INVENTION

In view of the foregoing disadvantages inherent in the known types of caps for dispensing systems now present in the prior art, the present invention provides an improved pump dispenser plug, and overcomes the above-mentioned disadvantages and drawbacks of the prior art. As such, the general purpose of the present invention, which will be described subsequently in greater detail, is to provide a new and improved pump dispenser plug and method which has all the advantages of the prior art mentioned heretofore and many novel features that result in a pump dispenser plug which is not anticipated, rendered obvious, suggested, or even implied by the prior art, either alone or in any combination thereof To attain this, the present invention essentially comprises a circular base with a perpendicular shaft upon which is mounted a conical structure comprised of removable, conical layers.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pump dispenser plug that has all of the advantages of the prior art caps for dispensing systems and none of the disadvantages.

It is another object of the present invention to provide a new and improved pump dispenser plug that may be easily and efficiently manufactured and marketed.

An even further object of the present invention is to provide a new and improved pump dispenser plug that has a low cost of manufacture with regard to both materials and labor, and which accordingly is then susceptible of low prices of sale to the consuming public, thereby making such a pump dispenser plug economically available to the buying public.

Still another object of the present invention is to provide a new pump dispenser plug that provides in the apparatuses and methods of the prior art some of the advantages thereof, while simultaneously overcoming some of the disadvantages normally associated therewith.

Even still another object of the present invention is to provide a pump dispenser plug for preventing the contents of pump dispenser containers from drying and collecting on the outside tip of the dispenser. This allows the user to fully dispense the contents of the bottle without encountering blockages due to dried product in the nozzle and saves the consumer a considerable amount of money by preventing premature replacement of the product.

Yet another object of the present invention is to provide a pump dispenser plug that reduces the likelihood that obstructions due to dried product will form a blockage in pump dispenser nozzles. This decreases the number of spills and stains on clothing and carpeting due to the forceful expulsion of product when the blockage in the nozzle is finally expelled.

Sill yet another object of the present invention is to provide a pump dispenser plug that is easily adaptable in size. This allows the consumer to use the plug on various types of containers without the need to purchase plugs of various sizes.

Lastly, it is an object of the present invention to provide a new and improved pump dispenser plug that is disposable. This allows the user to conveniently plug any number of pump dispenser type containers without concern for cost or the need to clean messy contents from a plug in order to reuse it.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
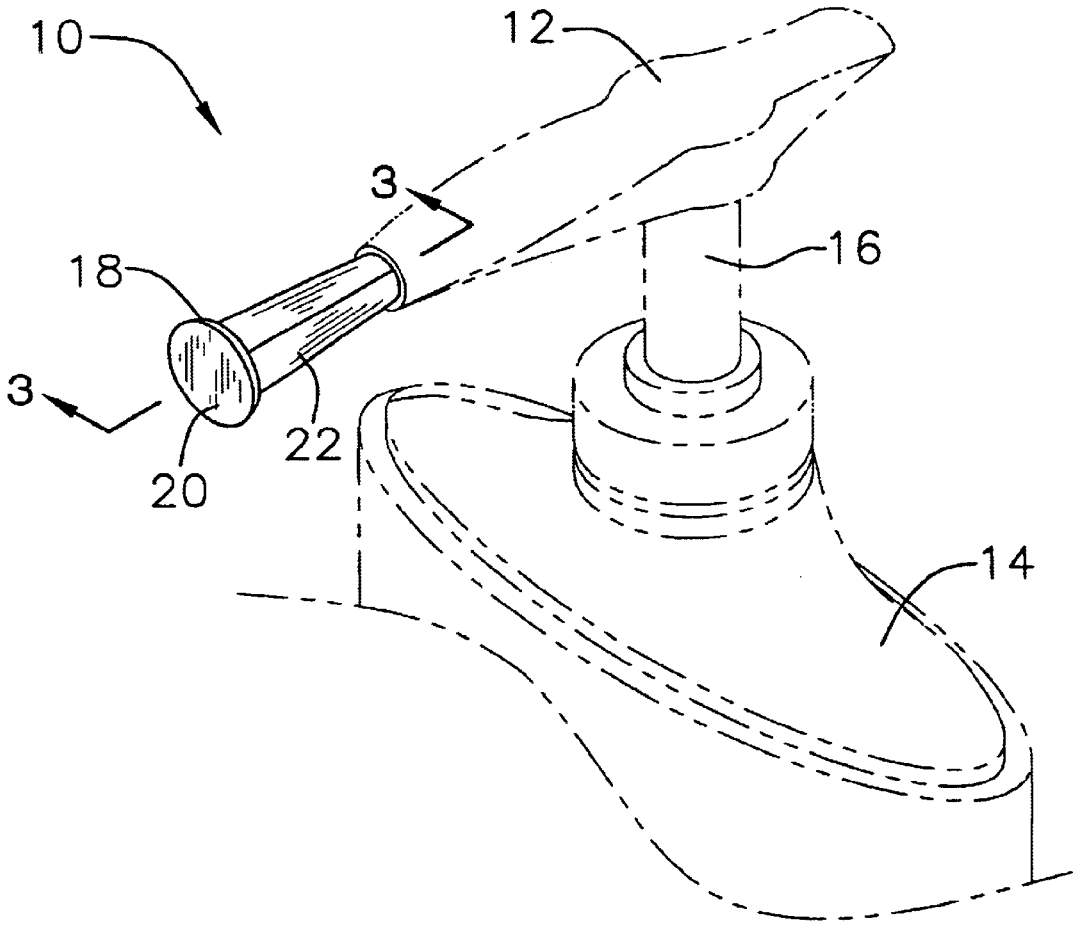
FIG. 1 is a right side perspective view of the preferred embodiment of the pump dispenser plug constructed in accordance with the principles of the present invention and mounted in the nozzle of a pump dispenser container.
Figure 2:
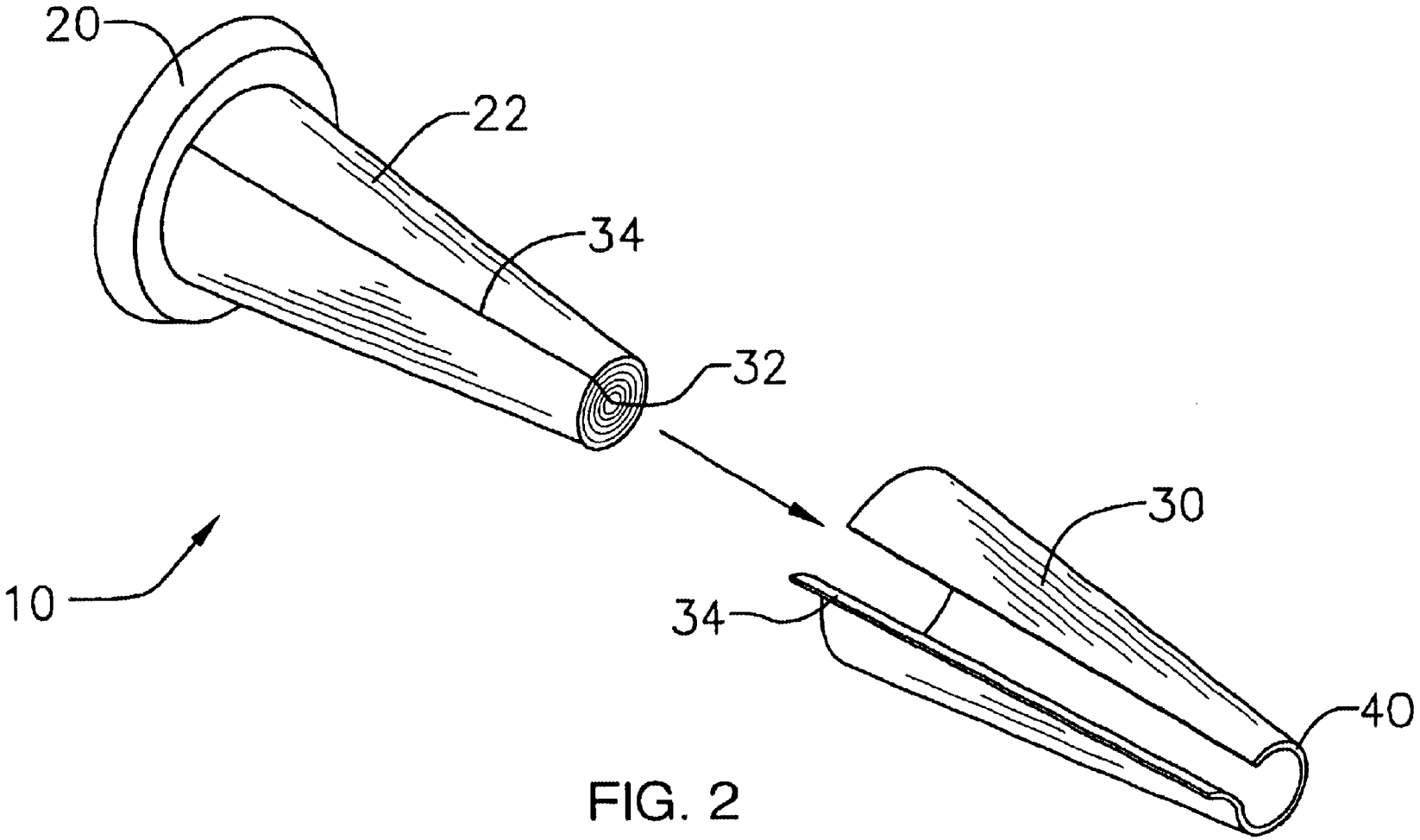
FIG. 2 is a left side perspective view of the pump dispenser plug of the present invention.
Figure 3:
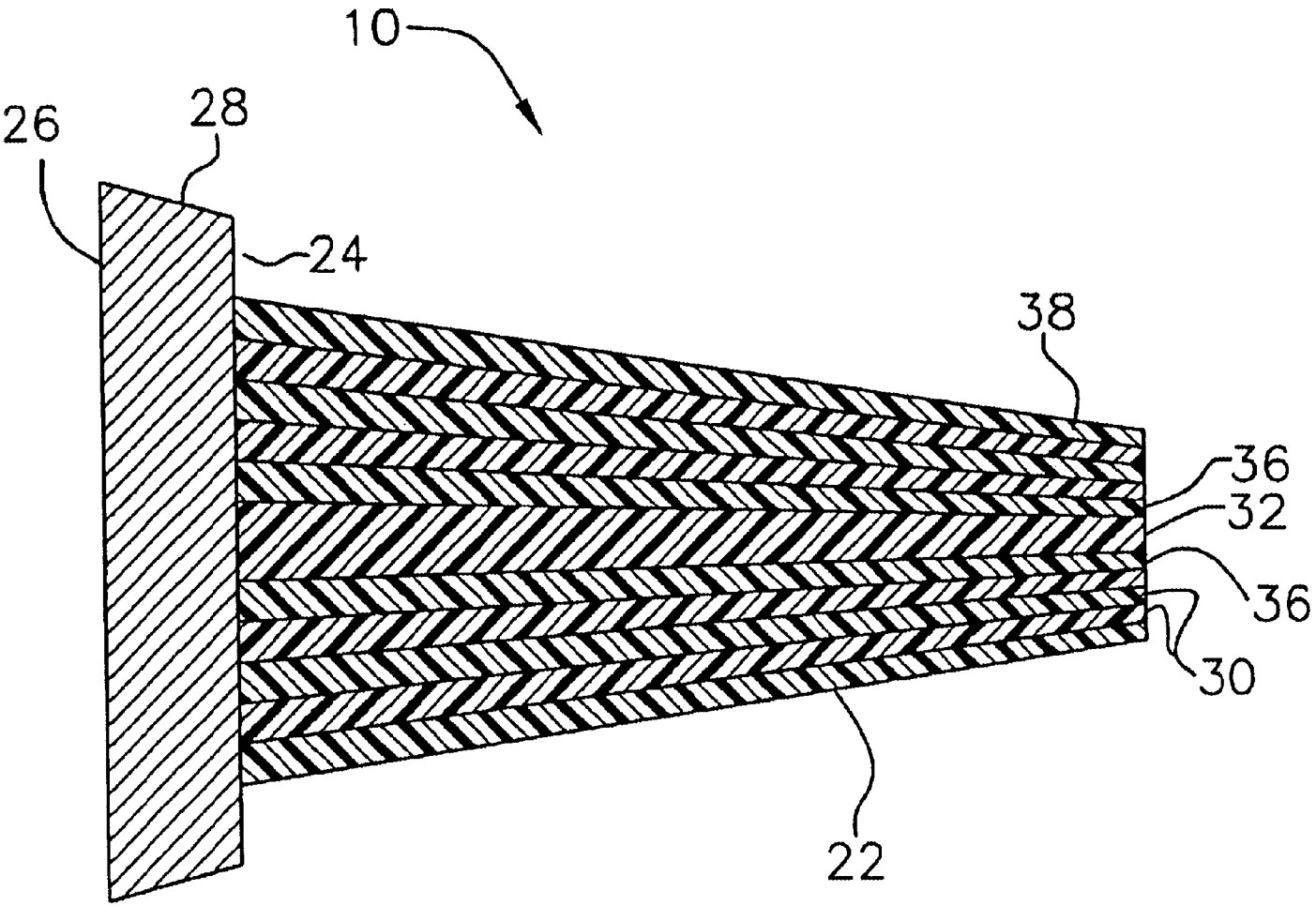
FIG. 3 is a right cross sectional view of the pump dispenser plug of the present invention taken along the longitudinal axis.

Referring now to the drawings, and particularly to FIGS. 1–3, a preferred embodiment of the pump dispenser plug of the present invention is shown and generally designated by the reference numeral 10.

In FIG. 1, a new and improved pump dispenser plug 10 of the present invention for preventing the contents of pump dispenser containers from drying and collecting on the outside tip of the dispenser is illustrated and will be described. More particularly, the pump dispenser plug 10 is shown inserted into the nozzle 12 of a pump dispenser container 14. The nozzle 12 is long and thin and forms the top of the pump dispenser 16. The plug 18 has a circular base 20 with a conical shaft 22 that extends perpendicularly from the base 20. The plug 18 would be made of durable, yet flexible, plastic.

FIGS. 2 and 3 show the adaptability of the pump dispenser plug 10 with a left side perspective view in FIG. 2 and a right cross sectional view in FIG. 3. The base 20 has a top surface 24, a bottom surface 26, and an outer edge 28 that angles inward from the bottom surface to the top surface. The conical shaft 22 is formed of removable conical layers 30 built around a central post 32 that extends perpendicularly from the base 20. The layers 30 allow a custom fit for nozzles 12 of varying widths and are formed with an access slit 34 for easy removal from the plug 18. These layers 30 are incrementally larger from the innermost layer 36 to the outermost layer 38 and are placed on the post 32 in a manner wherein the access slits 34 for each layer 30 are aligned. Each layer 30 has a conical shape that terminates in a tip 40.

In use, an individual would purchase lotions, liquid soaps, and other similar products packaged in pump dispenser containers 14. When these products were not in use, a pump dispenser plug 10 would be inserted, tip 40, into the nozzle 12 of the container 14, thereby eliminating the contents from drying out and gathering at the opening. If the pump dispenser plug 10 proved to be too large for the nozzle 12, the individual would simply remove the appropriate number of layers 30 until the proper fit was achieved. After the contents of the container 14 were depleted, the individual could simply discard the plug 18 along with the container 14.

While a preferred embodiment of the pump dispenser plug has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable flexible and liquid nonpermeable material such rubber or synthetics may be used instead of the plastic plug described. In addition, the base and the post of the plug could be formed as a single unit from such materials as plastic, rubber, metal, or wood. And although preventing the contents of pump dispenser containers from drying and collecting on the outside tip of the dispenser has been described, it should be appreciated that the pump dispenser plug herein described is also suitable for insertion into various types of openings such as glue bottles, toothpaste tubes, and similar items to help prevent collection of the product in the tip and subsequent drying. Furthermore, the pump dispenser plug could be used as a replacement cap for items sold in squeeze type packaging such as toothpaste, creams, lotions, shampoos, gels, and glue.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pump dispenser plug comprising:

a circular disc having a top surface with a center and an outer edge, a bottom surface with an outer edge and parallel to said top surface, and a side wall joining said outer edge of said top surface to said outer edge of said bottom surface; and a conical shaft having a wide base and a pointed tip and connected on said base to said top surface of said disc;

said conical shaft comprising:

a support rod having a first end and a second end; and a plurality of flexible conical layers of incremental sizes from a smallest layer to a largest layer, each formed with an outer surface and a hollow interior and having a tip and a circular base that is wider than said tip, and connected to said support rod wherein said tip of said smallest layer is removably connected to said first end of said support rod and said base of said first layer is removably connected to said second end of said support rod and each of said other layers is removably and incrementally connected to said layer that is just smaller than said other layer wherein said tips are aligned on said first end of said rod and said bases are aligned on said second end of said rod.

2. The pump dispenser plug of claim 1 wherein each of said plurality of layers is formed with a longitudinal slit from said tip to said base along said outer surface.

3. The pump dispenser plug of claim 2 wherein said layers are arranged wherein said longitudinal slit of each said layer is parallel to said rod and aligned with said longitudinal slit of each said other layer.

4. The pump dispenser plug of claim 1 wherein said second end of said rod is connected perpendicularly to said center of said top surface of said base.

5. The pump dispenser plug of claim 4 wherein the diameter of said base of said largest layer is smaller than the diameter of said top surface of said disc.

6. The pump dispenser plug of claim 1 wherein the dimensions of said tip of said conical shaft allow said tip to be inserted into the outer nozzle opening of a typical pump dispenser container such as those used for lotion and liquid soap.

7. The pump dispenser plug of claim 6 wherein said dimensions of said tip of said conical shaft can be reduced by removing some of said plurality of layers from said conical shaft.

8. The pump dispenser plug of claim 1 wherein said layers are formed of flexible plastic.

9. The pump dispenser plug of claim 1 wherein said disc and said rod are formed as a single unit and are comprised of a material from the list of plastic, rubber, metal, and wood.

10. A pump dispenser plug comprising:

a support member having a top surface with a center and an outer edge, a bottom surface with an outer edge and parallel to said top surface, and a side wall joining said outer edge of said top surface to said outer edge of said bottom surface; and a support rod having a first end and a second end and perpendicularly connected on said second end to said center of said top surface of said support member; and a plurality of flexible conical layers of incremental sizes from a smallest layer to a largest layer, each formed with an outer surface and a hollow interior and having a tip and a circular base that is wider than said tip, and connected to said support rod wherein said tip of said smallest layer is removably connected to said first end of said support rod and said base of said first layer is removably connected to said second end of said support rod and each of said other layers is removably and incrementally connected to said layer that is just smaller than said other layer wherein said tips are aligned on said first end of said rod to form a conical tip and said bases are aligned on said second end of said rod.

11. The pump dispenser plug of claim 10 wherein said side wall of said support member is angled upward and inward from said outer edge of said bottom surface to said outer edge of said top surface.

12. The pump dispenser plug of claim 11 wherein said support member is circular.

13. The pump dispenser plug of claim 10 wherein each of said plurality of layers is formed with a longitudinal slit from said tip to said base along said outer surface.

14. The pump dispenser plug of claim 13 wherein said layers are arranged wherein said longitudinal slit of each said layer is parallel to said rod and aligned with said longitudinal slit of each said other layer.

15. The pump dispenser plug of claim 10 wherein the diameter of said base of said largest layer is smaller than the diameter of said top surface of said support member.

16. The pump dispenser plug of claim 10 wherein the dimensions of said conical tip of said plurality of layers allow said conical tip to be inserted into the outer nozzle opening of a typical pump dispenser container such as those used for lotion and liquid soap.

17. The pump dispenser plug of claim 16 wherein said dimensions of said conical tip are reduced by removing some of said plurality of layers.

18. The pump dispenser plug of claim 10 wherein said layers are formed of flexible plastic.

* * * * *